US010863259B2

(12) United States Patent
Ohno

(10) Patent No.: US 10,863,259 B2
(45) Date of Patent: Dec. 8, 2020

(54) HEADPHONE SET

(71) Applicant: YAMAHA CORPORATION, Hamamatsu (JP)

(72) Inventor: Taku Ohno, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/575,854

(22) Filed: Sep. 19, 2019

(65) Prior Publication Data

US 2020/0014997 A1 Jan. 9, 2020

Related U.S. Application Data

(63) Continuation of application No. PCT/JP2017/011105, filed on Mar. 21, 2017.

(51) Int. Cl.

*H04R 1/10* (2006.01)
*H04R 27/00* (2006.01)
*H04R 29/00* (2006.01)

(52) U.S. Cl.

CPC ..... *H04R 1/1041* (2013.01); *H04R 1/1083* (2013.01); *H04R 27/00* (2013.01); *H04R 29/007* (2013.01); *H04R 2227/001* (2013.01); *H04R 2227/003* (2013.01); *H04R 2227/007* (2013.01); *H04R 2430/01* (2013.01); *H04R 2460/01* (2013.01)

(58) Field of Classification Search

CPC .... H04R 1/1041; H04R 1/1083; H04R 27/00; H04R 29/007; H04R 2460/01; H04R 2430/01; H04R 2227/007; H04R 2227/001; H04R 2227/003

See application file for complete search history.

(56) References Cited

U.S. PATENT DOCUMENTS

2002/0040255 A1 4/2002 Neoh
2010/0150383 A1 6/2010 Sampat
(Continued)

FOREIGN PATENT DOCUMENTS

JP 2002186079 A 6/2002
JP 2008067258 A 3/2008
(Continued)

OTHER PUBLICATIONS

International Search Report issued in Intl. Appln No. PCT/JP2017/011105 dated Jun. 6, 2017. English translation provided.
(Continued)

*Primary Examiner* — Andrew L Sniezek
(74) *Attorney, Agent, or Firm* — Rossi, Kimms & McDowell LLP

(57) ABSTRACT

A headphone set includes receivers, a signal processor that applies a given processing to each of audio signals received by respective ones of the receivers, a first adder that adds left signals together, to which the given processing is applied, a second adder that adds right signals together, to which the given processing is applied, a first sound output device that outputs a sound based on an output signal of the first adder, and a second sound output device that outputs a sound based on an output signal of the second adder.

3 Claims, 3 Drawing Sheets

(56) References Cited

U.S. PATENT DOCUMENTS

| | | | | |
|---|---|---|---|---|
| 2012/0283015 | A1 | 11/2012 | Bonanno | |
| 2017/0156006 | A1* | 6/2017 | Dennis | H04R 5/04 |

FOREIGN PATENT DOCUMENTS

| | | | |
|---|---|---|---|
| JP | 2012511869 | A | 5/2012 |
| WO | 2010068351 | A1 | 6/2010 |

OTHER PUBLICATIONS

Written Opinion issued in Intl. Appln. No. PCT/JP2017/011105 dated Jun. 6, 2017.
Office Action issued in Japanese Appln. No. 2019-506567 dated Oct. 6, 2020. English translation provided.

* cited by examiner

HEADPHONE SET

This application is a Continuation Application of PCT Application No. PCT/JP2017/011105, filed on Mar. 21, 2017, the entire contents of which are incorporated herein by reference.

BACKGROUND

Technical Field

The present invention relates to a headphone set.

Japanese Patent Application Laid-Open Publication No. JP2008-67258 discloses a wireless headphone set that receives a wirelessly transmitted audio signal, and enables a user to listen to a sound based on the received signal. A wireless headphone set provides an advantage over a wired headphone set in that a user of a wireless headphone set is free from restrictive audio cables and thus is able to move around with ease.

There are situations in which a group of music performers when playing musical instruments (or singing) wear wireless headphone sets, thus enabling the music performers to listen to a sound of her/his instrument while listening to sounds produced by other of the music performers and so blend her/his playing with that of the other music performers without disturbance caused by audible intrusion of extraneous sounds.

When collaborative music performers each wear a wireless headphone set, although the music performers are able to move around with ease, various disadvantages may result from such movement that could interfere with a musical performance.

SUMMARY

The present invention has been made in view of the circumstances described above. An object of the present invention is to provide a technique that minimizes interference with a musical performance of performers where each of the music performers wears a wireless headphone set while performing music collaboratively.

In order to achieve the stated object, a headphone set according to an aspect of the present invention includes: a plurality of receivers, a signal processor configured to apply a given processing to each of a plurality of audio signals received by respective ones of the plurality of receivers, an adder configured to add output signals of the signal processor together, to which the given processing is applied by the signal processor; and a sound output device configured to output a sound based on an output signal of the adder.

DESCRIPTION OF THE EMBODIMENTS

A summary of a system including headphone sets according to an embodiment of the present invention will now be described. In the system, there is envisaged, for example, a case where there are four music performers playing musical instruments and wearing headphone sets, and where processing such as audio mixing is applied to sounds generated by playing of the musical instruments, and the sounds subjected to the processing are supplied to the headphone sets. The number of music performers is not limited to four.

In the embodiment described, it is assumed that a performance space used by the music performers is relatively large such as an outdoor stage, a public hall or the like. However the performance space may be relatively small such as a studio. One reason why the music performers wear the headphone sets is to enable them to concentrate on their musical performance while listening to sounds produced by their musical instruments in an environment where disturbance caused by extraneous sounds, for example, cheers and other sounds incidental to the musical performance is reduced, as described above. It is of note that sounds produced by a microphone other than that of the headphone sets is not intended to be excluded. Another reason why the headphone sets are worn is to minimize lag in tempo and/or rhythm, given that a relatively long distance may exist between music performers resulting in a perceptible delay in sound transmission through air.

Since music performers not only perform music while remaining static but may also perform while moving around, use of audio cables to transmit audio signals representative of musical sounds or the like to the headphone sets causes inconvenience to the music performers. Thus, as mentioned above, the system according to the embodiment is configured to supply audio signals based on the musical performance with use of the musical instruments to the headphone sets wirelessly.

Although in the embodiment the audio signals are signals representative of sounds produced by musical instruments or the like, the acoustic signals may be signals representative of sounds produced by voice, namely vocal sounds.

Figure 1:
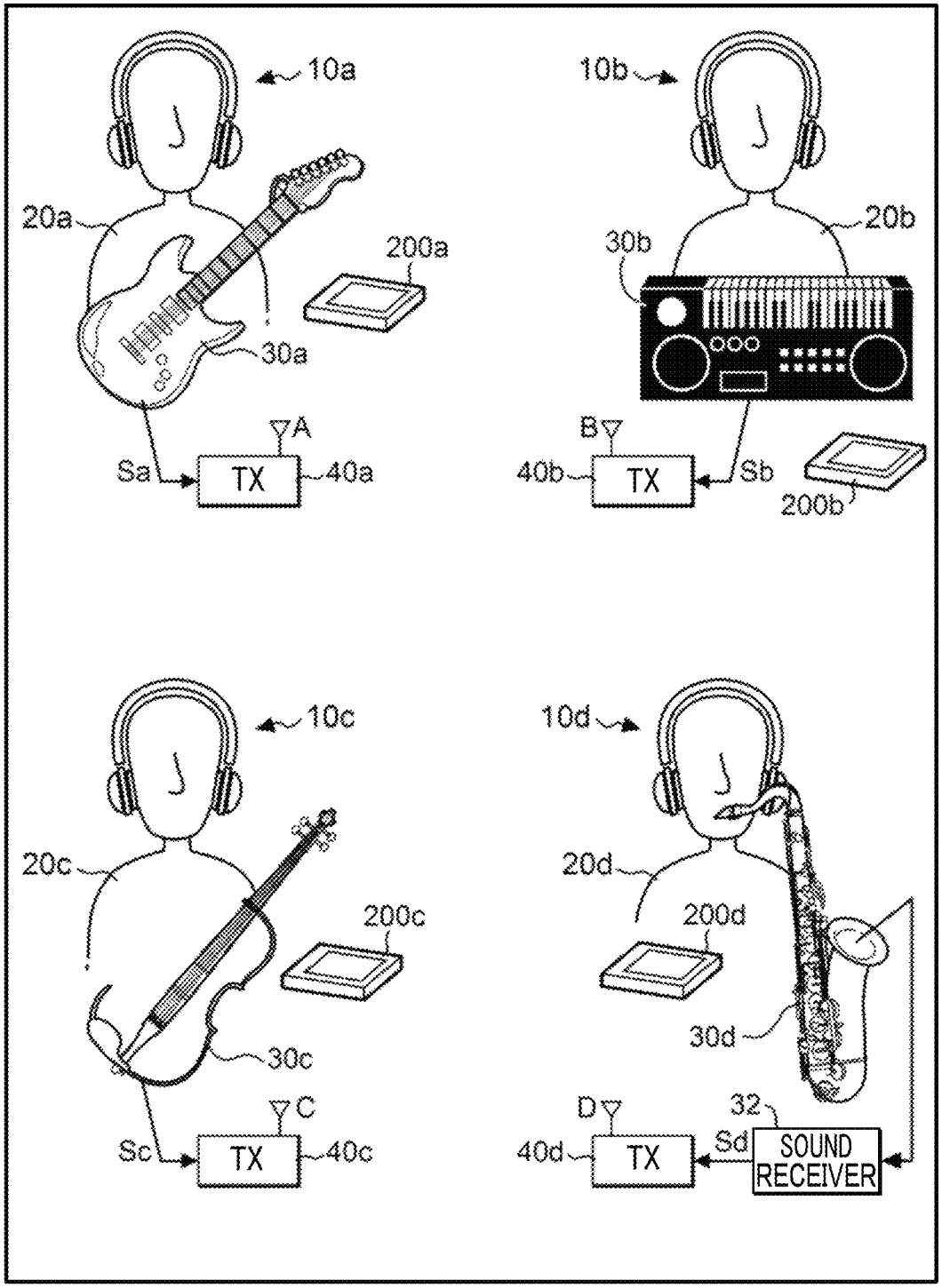
FIG. 1 is a drawing showing a system including headphone sets.

FIG. 1 is a drawing showing a relationship in the system between music performers, musical instruments, and headphone sets.

As shown in the drawing, four music performers 20*a*, 20*b*, 20*c* and 20*d* wear wireless headphone sets and play musical instruments. Specifically, the music performer 20*a* wears a headphone set 10*a* and plays a musical instrument 30*a*, while listening to a musical sound produced by the musical instrument 30*a* that she/he plays, and musical sounds produced by the musical instruments that the music performers 20*b*, 20*c* and 20*d* play. Similarly, the music performer 20*b* wears a headphone set 10*b* and plays a musical instrument 30*b* while listening to a musical sound produced by the musical instrument 30*b* that she/he plays, and musical sounds produced by the musical instruments that other of the music performers play. The music performer 20*c* wears a headphone set 10*c* and plays a musical instrument 30*c* while listening to a musical sound produced by the musical instrument 30*c* that she/he plays, and the music sounds produced by the musical instruments that other of the music performers play. The music performer 20*d* wears a headphone set 10*d* and plays a musical instrument 30*d* while listening to a musical sound produced by the musical instrument 30*d* that she/he plays, and the musical sounds produced by other of the musical instruments that other of music performers play.

The headphone set 10*a* is communicable with an external device 200*a* such as a smartphone. Similarly, the headphone set 10*b* is communicable with an external device 200*b*. The headphone set 10*c* is communicable with an external device 200*c*. The headphone set 10*d* is communicable with an external device 200*d*.

In the example, the musical instrument 30*a* is an electric guitar. The musical instrument 30*a* outputs a digital audio signal Sa, for example. The musical instrument 30*b* is an electric piano. The musical instrument 30*b* outputs an digital audio signal Sb. The musical instrument 30*c* is an electric violin. The musical instrument 30*c* has pickups in a bridge, and converts a sound produced by string vibration into a digital audio signal Sc using the pickups, to output the audio signal Sc. The musical instrument 30*d* is an acoustic saxophone having a sound receiver 32 provided inside a bell of the instrument. The sound receiver 32 converts a sound produced by the saxophone into a digital audio signal Sd, to output the audio signal Sd.

The described musical instruments are examples, and are not limited to those shown in the drawing.

A transmitter (referred to as "TX" in the drawing) 40*a* transmits the audio signal Sa on a wireless channel A. Similarly, a transmitter 40*b* transmits the audio signal Sb on a wireless channel B. A transmitter 40*c* transmits the audio signal Sc on a wireless channel C. A transmitter 40*d* transmits the audio signal Sd on a wireless channel D. A wireless system used by the transmitters 40*a*, 40*b*, 40*c* and 40*d* preferably conforms to a short range wireless communication standard such as Bluetooth (registered trademark), but is not limited thereto. The wireless system may be a system in which infrared light or the like is used.

The headphone sets 10*a*, 10*b*, 10*c* and 10*d* will now be described. Hereafter, description of the headphone set 10*a* also includes the headphone sets 10*b*, 10*c* and 10*d*, since an electrical configuration of the four headphone sets is the same.

Figure 2:
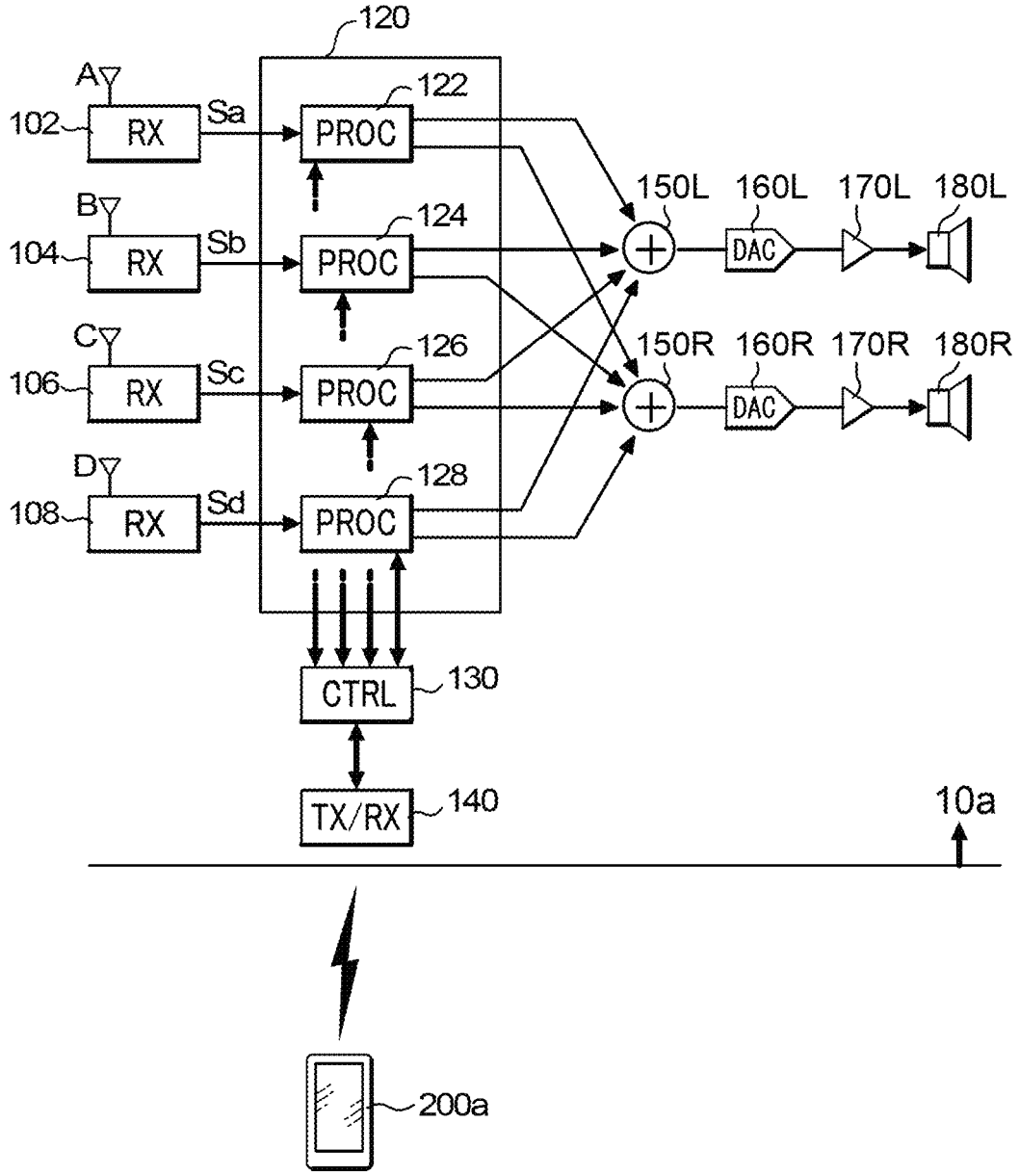
FIG. 2 is a block diagram showing a configuration of a headphone set in the system.

FIG. 2 is a block diagram showing an electrical configuration of the headphone set 10*a*. As shown in the drawing, the headphone set 10*a* includes receivers (referred to as "RX" in the drawing) 102, 104, 106 and 108, a signal processor 120, a controller (referred to as "CTRL" in the drawing) 130, a communicator (referred to as "TX/RX" in the drawing) 140, adders 150L and 150R, Digital Analog Convertor (DAC) 160L and 160R, amplifiers 170L and 170R, and sound output devices 180L and 180R.

The receiver 102 receives the audio signal Sa transmitted from the transmitter 40*a* on the wireless channel A, and supplies the audio signal Sa to the signal processor 120. Similarly, the receiver 104 receives the audio signal Sb transmitted from the transmitter 40*b* on the wireless channel B, and supplies the audio signal Sb to the signal processor 120. The receiver 106 receives the audio signal Sc transmitted from the transmitter 40*c* on the wireless channel C, and supplies the audio signal Sc to the signal processor 120. The receiver 108 receives the audio signal Sd transmitted from the transmitter 40*d* on the wireless channel D, and supplies the audio signal Sd to the signal processor 120.

The signal processor 120 includes processors (referred to as "PROC" in the drawing) 122, 124, 126 and 128. The processor 122 applies signal processing to the audio signal Sa received by the receiver 102. Similarly, the processor 124 applies signal processing to the audio signal Sb received by the receiver 104. The processor 126 applies signal processing to the audio signal Sc received by the receiver 106. The processor 128 applies signal processing to the audio signal Sd received by the receiver 108. The signal processing applied by each of the processors 122, 124, 126 and 128 includes volume control, distortion, reverberation, panning and equalizing and the like.

Since the signal processing includes panning, output signals of the processor 122 constitute two signals, specifically, a left channel signal and a right channel signal, that are generated by splitting the audio signal Sa into left and right channels. Similarly, the output signals of each of the processors 124, 126 and 128 constitute a left channel signal and a right channel signal.

The controller 130 sets for each of the processors 122, 123, 126 and 128 a processing content of the signal processing, such as ON/OFF switching of the signal processing, and adjustment of a volume level. Specific content of the signal processing is input to the controller 130 by operation of the music performer 20*a* that operates the external device 200*a*. The controller 130 obtains the input information, which is to be supplied to the each processor, via the communicator 140. In other words, the controller 130 is configured to obtain the information, which has been input to the external device 200*a*, via the communicator 140, and to set the content of the signal processing for each of the processors 122, 123, 126 and 128 based on the obtained information.

Furthermore, the controller 130 supplies the audio signals, each of which is a signal output by a corresponding processor among the processors 122, 124, 126 and 128, or a signal obtained by applying the processing to the supplied signal, to the external device 200*a* via the communicator 140. Then the controller 130 stores the audio signals in the external device 200*a*. In addition, when the external device 200*a* plays the audio signals stored therein, the controller 130 transfers each of the audio signals to a corresponding processor among the processors 122, 123, 126 and 128. In this case, each of the processors 122, 123, 126 and 128 applies the signal processing to the supplied audio signal.

As for the left channel, the adder 150L adds the left channel signals together, which are output from the respective processors 122, 124, 126 and 128. The DAC 160L converts an output signal of the adder 150L into an analog signal. The amplifier 170L amplifies the analog signal of the DAC 160L, and supplies the amplified analog signal to the sound output device 180L. The sound output device 180L converts the amplified signal and outputs the converted sound as vibration in air.

Similarly to the right channel, the adder 150R adds the right channel signals together, which are output from the respective processors 122, 124, 126 and 128. The DAC 160R converts an output signal of the adder 150R into an analog signal. The amplifier 170R amplifies the analog signal of the DAC 160R, and supplies the amplified analog signal to the sound output device 180R. The sound output device 180R converts the amplified analog signal into a sound, and outputs the converted sound.

The communicator 140 receives information from the external device 200*a* and transmits the information to the external device 200*a*. In FIG. 2, wireless communication is performed between the communicator 140 and the external device 200*a*. However, wired communication between the devices may instead be used.

In the embodiment, examples of information that the communicator 140 receives from the external device 100*a* include information that defines the content of the signal processing applied by each of the processors 122, 124, 126 and 128, and the audio signals played by the external device 200*a*. Examples of information that the communicator 140 transmits to the external device 100*a* include audio signals, each of which is a signal output by a corresponding processor among the processors 122, 123, 126 and 128, or a signal obtained by applying the processing to the supplied audio signal.

The external device 200*a* has an application program pre-installed therein for control of the headphone set 10*a*.

When the music performer 20*a* instructs the external device 200*a* to start up the application program, the external device 200*a* executes the application program, whereby the external device 200*a* realizes the following functions: an reception unit that receives the content of the signal processing applied by the headphone set 10*a*, a memory unit that stores therein the audio signals (alternatively, the audio signals to which the signal processing is applied) received by the headphone set 10*a*, and a reproduction unit that (reproduces) plays, after a musical performance, the audio signals stored in the memory unit.

As for the function of the reception unit, the external device 200*a* may be configured to receive the content of processing applied by each of the processors 122, 124, 126, and 128 as follows.

For example, the external device 200*a* may have preinstalled therein templates for each kind of musical instrument. When the music performer 20*a* selects a template corresponding to a musical instrument for her/his use from among the templates, the external device 200*a* may receive the content corresponding to the selected musical instrument.

As for the function of the memory unit, the external device 200*a* may be configured such that the music performer 20*a* selects whether the memory unit stores therein the audio signals output by a corresponding processor among the processors 122, 124, 126 and 128, or the memory unit stores therein an audio signal obtained by applying the processing thereto. Furthermore, the external device 200*a* may be configured such that the music performer 20*a* selects an audio signal for storage in the memory unit, thereby eliminating from storage other audio signals.

As for the functions of the reproduction unit, the external device 200*a* may be configured to transmit the audio signals to the headphone set 10*a*. Furthermore, the external device 200*a* may be configured to output the audio signals to which a same processing as that applied by the signal processor 120 is applied.

The processor 122 receives, via the transmitter 40*a* and the receiver 102, a supply of the audio signal Sa representative of the musical sound produced by the musical instrument 30*a* that the music performer 20*a* wearing the headphone set 10*a* plays. Then the processor 122 applies the signal processing to the audio signal Sa.

The processor 124 receives, via the transmitter 40*b* and the receiver 104, a supply of the audio signal Sb representative of the musical sound produced by the musical instrument 30*b* that the music performer 20*b* plays. Then the processor 124 applies the signal processing to the audio signal Sb. Similarly, the processor 126 receives, via the transmitter 40*c* and the receiver 106, the audio signal Sc representative of the musical sound produced by the musical instrument 30*c* that the music performer 20*c* plays. Then the processor 126 applies the signal processing to the audio signal Sc. The processor 128 receives, via the transmitter 40*d* and the receiver 108, the audio signal Sd representative of the musical sound produced by the musical instrument 30*d* that the music performer 20*d* plays. Then the processor 128 applies the signal processing to the audio signal Sd. The adder 150L adds the left channel signals among signals including the left channel signals and right channel signals from the processors 122, 124, 126 and 128 together. Then the sound output device 180L outputs a sound. Meanwhile, the adder 150R adds the right channel signals together. Then the sound output device 180R outputs a sound.

Accordingly, the music performer 20*a* wearing the headphone set 10*a* can listen to mixed musical sounds, namely a musical sound produced by the musical instrument 30*a* that she/he plays and musical sounds produced by other of the musical instruments that other of music performers play.

Description of the headphone set 10*a* also includes the headphone sets 10*b*, 10*c* and 10*d*, since an electrical configuration of the four headphone sets is the same.

Hereafter, an example comparative to the embodiment will be described to show advantages obtainable according to the embodiment.

Figure 3:
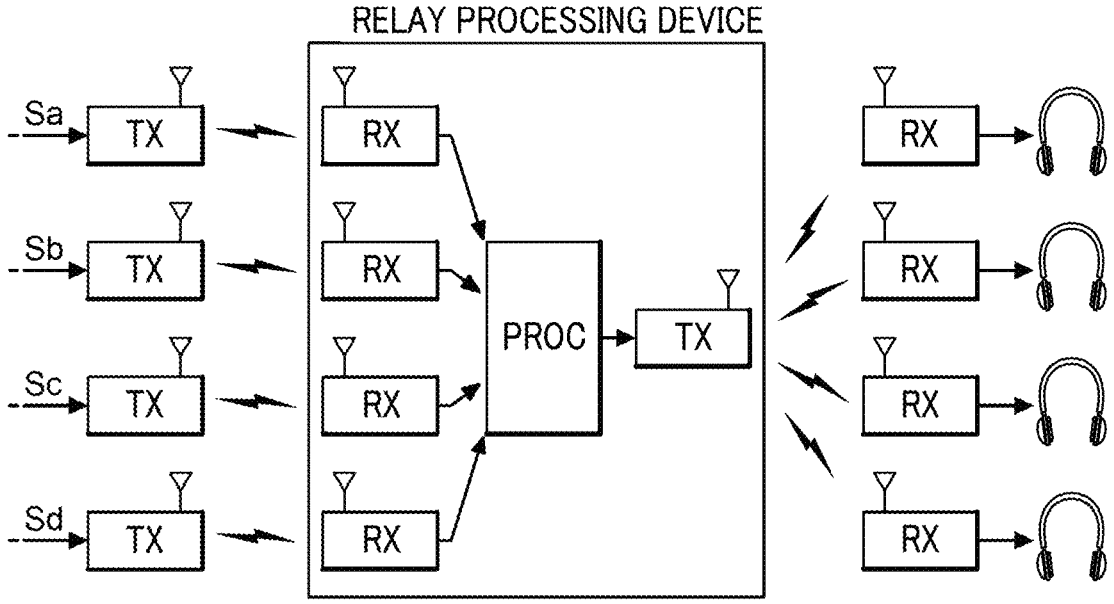
FIG. 3 is a drawing illustrating a comparative example of the system.

FIG. 3 is a block diagram showing an electrical configuration of a system according to the comparative example.

Similarly to the embodiment, in the comparative example, it is envisaged that four music performers wearing headphone sets play musical instruments. Given this situation, in the comparative example a system is envisaged in which processing such as audio mixing is applied to sounds generated by playing of the musical instruments, and the sounds subjected to the processing are supplied to the headphone sets.

The comparative example is similar to the embodiment in that audio signals are produced by the music performers, and the produced audio signals are transmitted by the transmitters. However, the comparative example differs from the embodiment in that a relay processing device is provided. Specifically, the relay processing device includes receivers, a processor and a transmitter. When the audio signals Sa, Sb, Sc and Sd are transmitted, the receivers in the relay processing device receive the respective audio signals Sa, Sb, Sc and Sd. The processor applies processing such as audio mixing and the like to the audio signals Sa, Sb, Sc and Sd. Then the transmitter in the relay processing device simultaneously transmits the audio signals to which the processing is applied. After that, the headphone sets receive the audio signals from the relay processing device via a corresponding receiver. Then the headphone sets output the respective sounds based on the audio signals via a corresponding sound output device.

Similarly to the embodiment, in the comparative example as mentioned above, each of the headphone sets receives a supply of the sounds to which processing such as audio mixing and the like are applied. In terms of this point only, the comparative example does not particularly differ from the embodiment. However, in a case where a relatively large performance space such as an outdoor stage, a public hall or the like is envisaged as a place for a musical performance, as mentioned above, radio wave reception may be impeded by reflection caused by buildings, for example.

In the comparative example, if a receiver in a headphone set loses communication with the relay processing device, a music performer wearing the headphone set suffers a loss of audio and is unable to hear musical sounds produced by playing of instruments of other music performers, and thus is unable to play her/his instrument in coordination with the playing of musical instruments by the other music performers.

According to the embodiment allowance is made for a possibility that interruption in one of the wireless channels may occur. It is unlikely, however, that interruption of all the wireless will occur. For example, if interruption occurs in the wireless channel D and affects the headphone set 10*a*, interruption of all of the wireless channels A, B and C is unlikely to occur at the same time. If interruption occurs in the wireless channel D and affects the headphone set 10*a*, unless interruption of the wireless channels A, B and C also occurs, according to the embodiment the music performers are able to listen to mixed musical sounds of the musical instruments 30*a*, 30*b* and 30*c*. Therefore, even if the music performer 20*a* wearing the headphone set 10*a* is unable to hear a musical sound produced by the instrument 30*d*, the music performer 20*a* is able to hear other musical sounds produced by the other musical instruments. As a result, it is possible to avoid a situation where each music performer is unable to play her/his musical instrument in coordination with the other music performers.

This is an example of a case where loss of musical sound occurs due to an interruption in radio wave reception. In a case where radio wave reception is not interrupted but a music performer is unable to hear musical sounds of other music performers, the embodiment provides an advantage in that failure of a device can be easily identified.

This advantage will be described in relation to the comparative example. In the configuration of the comparative example in FIG. 3 difficulty occurs in identifying whether loss of sound is caused by a transmitter that transmits the audio signal Sa, or loss of sound is caused by failure of a receiver in the relay processing device, or as a result of each of the foregoing circumstances. This remains the case unless it is possible for a musical sound based on the audio signal Sa, for example, to be heard.

According to the embodiment, it is possible to identify a cause of loss of sound as follows. Assuming as an example that the headphone set 10*a* fails to output a musical sound produced by the musical instrument 30*a* due to interruption of the wireless channel, as long as the other headphone sets 10*b*, 10*c* and 10*d* can output the musical sound, it follows that transmitter 40*a* has not failed, and that the loss of sound is due to failure of the receiver 102 or another related component. Thus, according to the embodiment the cause of the loss of sound can be identified. Conversely, if the headphone set 10*a* can output musical sounds produced by the musical instruments 30*b*, 30*c* and 30*d*, unless all of the headphone sets 10*a*, 10*b*, 10*c* and 10*d* output that musical sounds it follows that loss of sound is due to failure of the transmitter 40*a* relating to the musical instrument 30*a* or another related component, whereby according to the embodiment the failure can be identified.

In the comparative example, the audio signals pass through the following stages: transmission by the musical instruments, reception by the relay processing device, processing such as audio mixing by the relay processing device, and reception by the headphone sets. In contrast, in the embodiment, the audio signals pass through the following steps only: transition by the musical instruments, reception by the relay processing device, and processing such as audio mixing by the headphone sets. As a result, according to the embodiment any delay that occurs at any stage of transmission and reception is minimized. Such a delay may result in a lag in tempo and/or rhythm when music performers play their musical instruments. According to the embodiment, since any delay is minimized, any lag in the tempo and/or rhythm can also be minimized.

The present invention is not limited to the foregoing embodiment, and may be modified in various ways as follows. One or more modes selected freely among the following modifications and aspects may also be combined.

According to the embodiment, the signal processor 120 splits each of the audio signals, which is a monaural signal and is output from a musical instrument, into left and right channels, whereby a left channel signal and a right channel signal are generated. However, each of the musical instruments may output a stereo signal, and the signal processor 120 may adjust a balance between the left channel signal and the right channel signal.

According to the embodiment, the audio signals output from the musical instruments are digitized. However, the audio signals output from the musical instruments may be analog.

As mentioned above, the audio signals may include sounds produced by voice, namely vocal sounds. Since vocal sounds based on the voice sound signals are output by the sound output devices 180L and 180R, occurrence of howling is reduced.

The headphone set 10*a* may include a microphone. In a case where the headphone set 10*a* is provided with the microphone, the microphone may receive an ambient sound. In order to minimize the ambient sound received by the microphone, the headphone set 10*a* may be provided with a noise-cancelling function. As for the noise-cancelling function, the headphone set 10*a* inverts (reverses) the phase of a signal representative of the received ambient sound picked up by the microphone. Then the headphone set 10*a* adds the inverted signal to both of an output signal from the adder 150L and an output signal from the adder 150R.

In a case of use of a musical instrument that produces a relatively loud sound, the headphone set 10*a* may reverse a phase of an audio signal produced by the musical instrument in order to reduce a volume of the musical sound produced by the instrument.

The following aspects are intended to understood in light of effect on the musical performance is reduced in a case where the music performers wearing the headphone sets play musical instruments.

First, the following is understood: a headphone set includes: a plurality of receivers; a signal processor configured to apply a given processing to each of a plurality of audio signals received by respective ones of the plurality of receivers; an adder configured to add output signals together, to which the given processing is applied by the signal processor; and a sound output device configured to output a sound based on an output signal of the adder.

The headphone set makes it possible to avoid a situation where any music performer is unable to play her/his instrument to match playing of other of the music performers. Furthermore, use of the headphone set shortens a relay, and thus an undesirable effect on musical performance by the performers is reduced.

The headphone set may be configured such that the adder includes a first adder and a second adder, the sound output device includes a first sound output device and a second sound output device, the given signal processing applied by the signal processor includes processing to split each of the plurality of audio signals into, at least, first and second channels, whereby a plurality of first signals corresponding to the first channel for respective ones of the plurality of audio signals and a plurality of second signals corresponding to the second channel for respective ones of the plurality of audio signals are generated, the first adder adds the plurality of first signals together, the second adder adds the plurality of second signals together, the first sound output device outputs a sound based on an output signal of the first adder, and the second sound output device outputs a sound based on a signal of the second adder.

The headphone set may be configured to include a communicator communicable with an external device, and a controller configured to set the given processing for the signal processor.

In the foregoing configuration of the headphone set, the communicator receives information indicative of content of the given processing, to transfer the information to the controller, where the content of the given processing is input by the external device, and the controller sets, based on the transferred information, the content of the given processing to the signal processor.

In the foregoing configuration, via the communicator, the controller causes the external device to store the plurality of audio signals received by the respective receivers, or the output signals of the signal processor.

DESCRIPTION OF REFERENCE SIGNS

10*a*, 10*b*, 10*c*, 10*d*: Headphone set
20*a*, 20*b*, 20*c*, 20*d*: Music performer
30*a*, 30*b*, 30*c*, 30*d*: Musical instrument
40*a*, 40*b*, 40*c*, 40*d*: Transmitter
102, 104, 106, 108: Receiver
130: Controller
150L, 150R: adder
180L, 180R: sound output device
200*a*: External device

What is claimed is:

1. A headphone set comprising:

a plurality of receivers each configured to receive an audio signal;

a signal processor configured to apply a given processing to each of the plurality of audio signals received by respective ones of the plurality of receivers;

an adder configured to add output signals of the signal processor together, to which the given processing is applied by the signal processor;

a sound output device configured to output a sound based on an output signal of the adder;

a communicator communicable with an external device including a storage device; and a controller configured to set the given processing for the signal processor, wherein the controller supplies to the external device, via the communicator, to cause the external device to store, in the storage device, the received plurality of audio signals or the output signals of the signal processor to allow the external device to reproduce the plurality of audio signals or the output signals of the signal processor.

2. The headphone set according to claim 1, wherein:

the adder includes a first adder and a second adder, the sound output device includes a first sound output device and a second sound output device, the given signal processing applied by the signal processor includes splitting each of the plurality of audio signals into, at least, first and second channels to generate a plurality of first signals corresponding to the first channel for respective ones of the plurality of audio signals and a plurality of second signals corresponding to the second channel for respective ones of the plurality of audio signals, the first adder adds the plurality of first signals together, the second adder adds the plurality of second signals together, the first sound output device outputs a sound based on an output signal of the first adder, and the second sound output device outputs a sound based on a signal of the second adder.

3. The headphone set according to claim 1, wherein:

the communicator receives information indicative of content of the given processing, to transfer the information to the controller, which supplies the content of the given processing to the external device, and the controller sets, based on the transferred information, the content of the given processing to the signal processor.

* * * * *